United States Patent [19]

Hagermo

[11] 4,057,312

[45] Nov. 8, 1977

[54] CONNECTING DEVICE AT A BUS BAR

[75] Inventor: Kjell Gustaf Roland Hagermo, Skarholmen, Sweden

[73] Assignee: Telefonaktiebolaget L M Ericsson, Stockholm, Sweden

[21] Appl. No.: 712,208

[22] Filed: Aug. 6, 1976

[30] Foreign Application Priority Data

Sept. 5, 1975 Sweden ..... 7509890

[51] Int. Cl.[2] ..... H01R 9/10

[52] U.S. Cl. ..... 339/21 R; 174/94 S; 339/270 R; 339/272 R

[58] Field of Search ..... 339/20, 21 R, 22 R, 339/22 B, 95 R, 263 R, 270 R, 272; 174/94 R, 94 S

[56] References Cited

U.S. PATENT DOCUMENTS

| | | | |
|---|---|---|---|
| 2,046,942 | 7/1936 | Goeller | 339/270 R |
| 3,183,476 | 5/1965 | Sacks | 339/270 R |
| 3,210,716 | 10/1965 | Meacham | 339/270 R |
| 3,551,876 | 12/1970 | Walter | 339/272 UC |

*Primary Examiner*—Roy Lake
*Assistant Examiner*—Mark S. Bicks
*Attorney, Agent, or Firm*—Hane, Sullivan & Spiecens

[57] ABSTRACT

A connecting device for connecting an electric wire to a bus bar, with a groove between two walls which form together a U-shaped section, characterized in that, a connecting piece has two inwardly sloping connecting surfaces to be pressed towards the edges of the U-shaped section and a screw through a central hole formed in the connecting piece, which is intended to engage with its thread in the insides of the walls of the U-shaped section when the connecting piece has been placed over the groove. The connecting piece also has two guiding prongs, on opposite sides of the screw which are intended to be inserted into the longitudinal groove of the bus bar.

5 Claims, 3 Drawing Figures

CONNECTING DEVICE AT A BUS BAR

BACKGROUND OF THE INVENTION

The present invention relates to a connecting device for connecting an electric wire to a bus bar, with a longitudinal groove between two walls which form together a U-shaped section.

In racks with plug-in units placed above each other feeding of electric power with different tensions and frequencies as well as grounding is usually achieved with bus bars, which are vertically arranged at the gables of the rack. The bus bars have sockets for electric power, often structured as a number of out-bent tabs, or as a number of holes in the bars where a terminal wire provided with cable clips may be connected. It is common for the connections to these bus bars hitherto used to be material and space consuming, while connection to the bus bar can only be made at places determined and prepared in advance.

SUMMARY OF THE INVENTION

With the device of the invention electric wires can be connected anywhere on the bus bar without previous punching. Compared with earlier known connecting devices, the device according to the invention gives as a result lower labour costs, less consumption of material and less space requirement.

BRIEF DESCRIPTION OF THE DRAWING

In the following an example of a connecting device according to the invention is described, whereby reference is made to the accompanying drawing where.

DETAILED DESCRIPTION OF THE INVENTION

Figure 1:
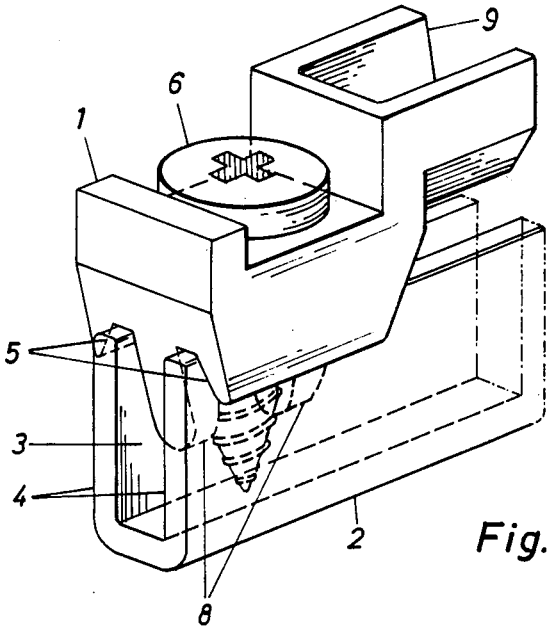
FIG. 1 shows a perspective drawing of the connecting piece and the bus bar.

In a connecting device, as shown in FIG. 1, there is included, among other things, a connecting piece 1, which is arranged in order to be connected to a bus bar 2, which has at least one groove 3 between two walls 4, which together with the groove 3 form a U-shaped section. The connecting piece 1 is, for that reason, provided with two inwardly sloping connecting surfaces 5.

Figure 2:
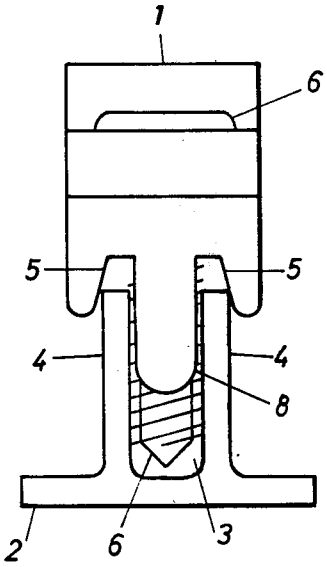
FIG. 2 shows an end view of the connecting piece and the bus bar.
Figure 3:
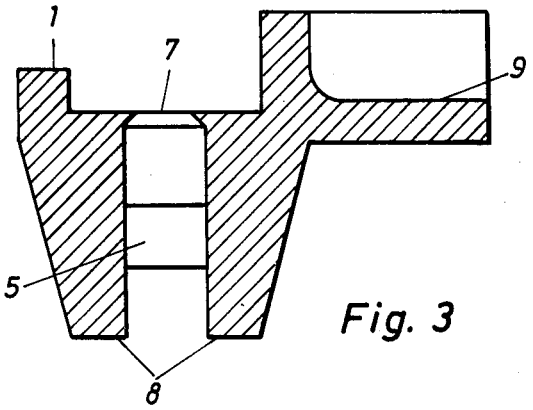
FIG. 3 shows a longitudinal section through the connecting piece.
Figure 4:
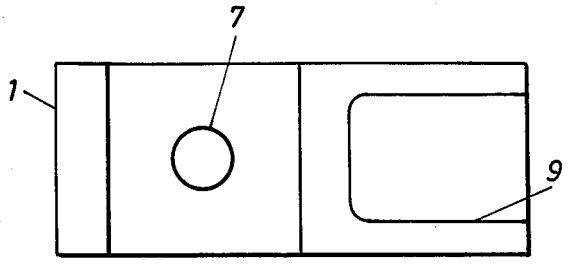
FIG. 4 shows a plan view of the connecting piece.

Furthermore, in the connecting device a screw 6 is included (see also FIG. 2) which is inserted through a hole in the connecting piece shown in FIGS. 3 and 4. The screw 6 is a screw with a triangular thread, the diameter of which is chosen so that its threads cut into the walls of the bus bar 4 when the screw is screwed through the connecting piece. The hole 7 for the screw is, as appears from FIG. 3, to its outermost part, made with a diameter less than the rest of the hole.

When tightening the screw 6, the inwardly sloping surfaces 5 of the connecting piece 1 will press the walls of the bus bar 4 towards each other, whereby it is guaranteed that the threads of the screw will have a solid grip in the walls of the bus bar.

To prevent the walls of the bus bar to be pressed too close to each other, the connecting piece has two guiding prongs 8, which on one hand extend alongside the screw 6 and steer it perpendicularly to the bus bar, and on the other hand, prevent the walls of the bus bar from pressing too close to each other.

Furthermore, the connecting piece 1 is provided with a recess 9 wherein an electric wire can be soldered.

The material of the bus bar is tinned copper and of the connecting piece tinned brass. The size of the device may, as measured by the width of the groove 3 between the walls of the bus bar 4, be 2.3 mm.

I claim:

1. A U-shaped bus bar and a connecting device for connecting an electric wire to said U-shaped bus bar, said bus bar having a first wall and a second wall, and a groove defined therebetween, said connecting device comprising: a connecting piece for connection to the bus bar having a main portion, a first surface extending downwardly from said main portion at one side thereof, a second surface extending downwardly from said main portion at the other side thereof so as to form an open gap therebetween with said first surface, each of said first and second surfaces having sloping surfaces which slope inwardly from the bottom thereof to the top thereof toward the other of said first and second surfaces, the distance between corresponding points on said sloping surfaces gradually decreasing so that along corresponding portions of said surfaces the distance therebetween is greater than the distance between the outer parts of said first and second walls of said bus bar and along the remaining corresponding portions of said surfaces the distance therebetween is less than the distance between the outer parts of said first and second walls, said inwardly sloping surfaces contacting said first and second walls to push said walls toward each other when said connecting piece is mounted to said bus bar, said main portion having an opening extending therethrough and formed between said first and second surfaces, said connecting piece further comprising a screw extending through said opening, said screw gripping the inner surfaces of said first and second walls to thereby mount said connecting piece to said bus bar, and means for electrically connecting an electric wire to said main portion and therefore to said bus bar via said first and second surfaces and said screw, said means being mounted on said main portion.

2. The bus bar and connecting device according to claim 1, wherein said opening is of smaller diameter near the top surface of said main portion to prevent the passage therethrough of the head of said screw.

3. The bus bar and connecting device according to claim 1, further comprising a first prong extending downwardly from the bottom surface of said main portion between said first and second inwardly sloping surfaces on one side of said screw, and a second prong extending downwardly from the bottom surface of said main portion between said first and second inwardly sloping surfaces on the other side of said screw, whereby said screw and therefore said connecting piece is guided between said first and second walls of said bus bar during mounting and where the inward movement of the walls of the bus bar is limited.

4. The bus bar and connecting device according to claim 3, wherein said means for connecting comprises a recess.

5. The bus bar and connecting device according to claim 3, wherein said screw comprises a triangular thread and is of such a diameter as to grip the inner surfaces of said first and second walls when they are urged toward each other by said first and second inwardly sloping surfaces.

* * * * *